US010738534B2

(12) United States Patent
Bø

(10) Patent No.: US 10,738,534 B2
(45) Date of Patent: Aug. 11, 2020

(54) DEVICE FOR THE NIVELLATION OF LADDERS

(71) Applicant: Inventu AS, Larvik (NO)

(72) Inventor: Bendik Bø, Larvik (NO)

(73) Assignee: Inventu AS, Larvik (NO)

( * ) Notice: Subject to any disclaimer, the term of this patent is extended or adjusted under 35 U.S.C. 154(b) by 12 days.

(21) Appl. No.: 15/766,995

(22) PCT Filed: Oct. 6, 2016

(86) PCT No.: PCT/NO2016/050201

§ 371 (c)(1),
(2) Date: Apr. 9, 2018

(87) PCT Pub. No.: WO2017/061874

PCT Pub. Date: Apr. 13, 2017

(65) Prior Publication Data

US 2018/0305981 A1 Oct. 25, 2018

(30) Foreign Application Priority Data

Oct. 8, 2015 (NO) ..... 20151343

(51) Int. Cl.
*E06C 7/44* (2006.01)
*E06C 7/18* (2006.01)
(Continued)

(52) U.S. Cl.
CPC ..... *E06C 7/188* (2013.01); *E06C 7/426* (2013.01); *E06C 7/44* (2013.01); *E06C 7/46* (2013.01)

(58) Field of Classification Search
CPC ..... E06C 7/44; E06C 7/188
(Continued)

(56) References Cited

U.S. PATENT DOCUMENTS 180,761 A * 8/1876 Groshon
2,205,935 A * 6/1940 Stenroos ..... E06C 7/44 182/200

(Continued)

FOREIGN PATENT DOCUMENTS

DE 3529040 A1 * 2/1987 ..... E06C 7/44
DE 3529040 A1 2/1987

(Continued)

OTHER PUBLICATIONS

PCT International Search Report in PCT International Application No. PCT/NO2016/050201 dated Feb. 3, 2017.

(Continued)

*Primary Examiner* — Alvin C Chin-Shue
(74) *Attorney, Agent, or Firm* — Greenberg Traurig, LLP; David J. Dykeman; Todd C. Basile

(57) ABSTRACT

It is disclosed a nivellation device making it possible to place ladders horizontally on sloping ground. Such a device comprises a foundation (1) onto which there is secured/placed an elevated area (2), said elevated area (2) functioning as a fulcrum/see-sawing point for a plate (3) onto which plate (3) there may be placed or secured a ladder (I), and said plate 3 being equipped with securing devices (4) that may stay the position of the plate (3) in relation to the foundation (1). Additionally it is disclosed a tightening device for a wire that may be used for securing the nivellation device in a correct horizontal orientation and a device for ensuring that the ladder is not displaced in relation to a house wall.

7 Claims, 5 Drawing Sheets

(51) Int. Cl.
*E06C 7/42* (2006.01)
*E06C 7/46* (2006.01)

(58) Field of Classification Search
USPC ..... 182/200
See application file for complete search history.

(56) References Cited

U.S. PATENT DOCUMENTS

| | | | | |
|---|---|---|---|---|
| 2,330,825 | A | 10/1943 | Hoit | |
| 3,903,991 | A | 9/1975 | Phelan | |
| 4,770,275 | A * | 9/1988 | Williams | E06C 7/44 182/202 |
| 5,222,575 | A | 6/1993 | Santos | |
| 7,597,294 | B2 * | 10/2009 | Lotz | F16M 7/00 182/200 |
| 8,042,651 | B1 * | 10/2011 | Michnik | E06C 1/14 182/107 |
| 2012/0037768 | A1 * | 2/2012 | Seibaek | A47B 91/16 248/163.1 |

FOREIGN PATENT DOCUMENTS

| | | | |
|---|---|---|---|
| DE | 202004013547 | U1 | 12/2004 |
| EP | 3359768 | B1 | 11/2019 |
| FR | 2816984 | A1 | 5/2002 |
| GB | 2186903 | A | 8/1987 |
| GB | 2330611 | A | 4/1999 |
| GB | 2336618 | A | 10/1999 |
| GB | 2492657 | A | 1/2013 |
| SE | 517635 | C2 | 6/2002 |
| SE | 529879 | C2 | 12/2007 |
| WO | 9114850 | A1 | 10/1991 |

OTHER PUBLICATIONS

PCT International Preliminary Report on Patentability in PCT International Application No. PCT/NO2016/050201 dated Jan. 4, 2018.

* cited by examiner

DEVICE FOR THE NIVELLATION OF LADDERS

CROSS-REFERENCE AND CLAIM OF PRIORITY TO RELATED APPLICATIONS

This application is a U.S. national phase application of PCT International Patent Application No. PCT/NO2016/050201, filed on Oct. 6, 2016, which claims the benefit of and priority to Norwegian patent application no. 20151343, filed Oct. 8, 2015, each of which are hereby incorporated by reference in their entireties.

AMBIT OF THE INVENTION

The present invention concerns a device for the nivellation of ladders that are erected on a sloping surface. Such a device comprises a foundation upon which there is secured/fastened an elevated area, said elevated area functioning as a fulcrum for a plate onto which plate a ladder may be carried or secured, and said plate being equipped with fastening devices that may secure the position of the plate in relation to the foundation.

BACKGROUND FOR THE INVENTION

The raising of ladders where the ground or surface is sloping in the cross-direction of the ladder makes it necessary to adjust one or both of the sides of the ladder so that the steps of the ladder run mainly horizontally. This has traditionally been accomplished by the one leg of the ladder hanging in the air being braced by bracing elements such as rocks, tiles, planks, etc. Such a support of the one leg of the ladder may cause the ladder to become unsteady and may have as a consequence that the entire ladder collapses if the support is not constructed sufficiently solid.

Other ways to solve this problem have been to equip the ladder with sides or legs that may be elongated, e.g. telescopically. This may be an ample solution for the problem mentioned supra, but leaves already existing ladders not being equipped with such telescoping legs, still being prone to the mentioned problem.

Thus there exists a need for a nivellation device for ladders without telescoping legs.

DISCLOSURE OF THE INVENTION

The invention will be disclosed infra with reference to the enclosed figures wherein.

Figure 1:
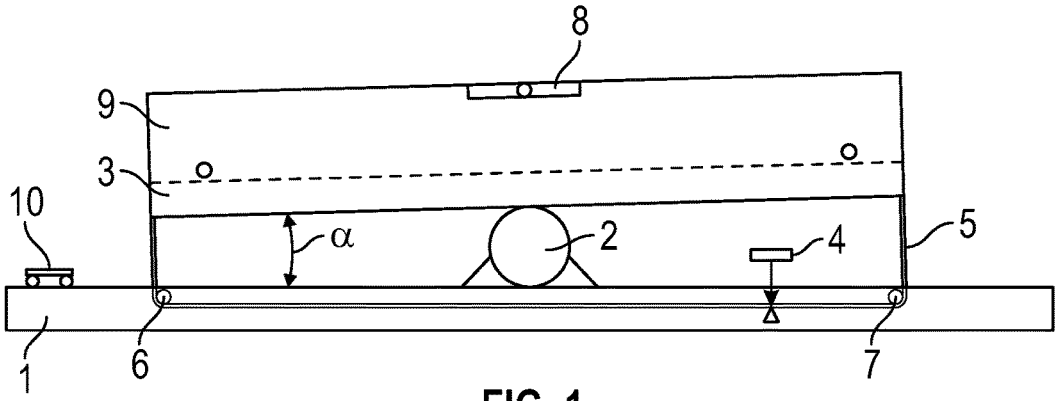
FIG. 1 depicts the construction of an embodiment of the device according to the invention.

As explained supra the present invention concerns a device for leveling ladders I being erected on a sloping surface II. Such a device comprises a foundation 1 onto which there is secured/fastened a raised area 2, said raised area 2 functioning as a fulcrum/see-sawing point for a plate 3 onto said plate 3 a ladder I may be carried or secured, and said plate 3 being equipped or associated with securing devices 4 that may secure the position of the plate 3 in relation to the foundation 1.

By being able to tilt the plate 3 about the fulcrum 2 its angle $\alpha$ in relation to the foundation 1 may be adjusted. The extremes for the adjustment angle $\alpha$ are dictated by the height of the elevated area 2 relative to the length of the plate 3 in such a way that the shorter the length of the plate 3 the larger the angle $\alpha$ may become. If the length of the plate 3 corresponds to the height of the elevated area 2, the angle may be up to 90°. The length of the plate 3 is, however, also dictated by the width of the ladder 1 to be carried by this. A ratio between the height of the elevated area 2 and the length of the plate 3 so that the angle may lie within the interval 0-60° is preferred. In practice this means that the nivellation device according to the invention may function as desired for a hill slope within a corresponding interval.

If e.g. a ladder 1 being 1 m wide, and the ladder 1 is to be carried by the plate 3 across its entire length, the fulcrum 2 is located at the middle of the plate 3 (also being preferred), the height (calculated as the distance from the foundation 1 to the top point/see-sawing point of the elevated area 2) may be up to (½ m sin) 60° being ¼ m. A lesser height of the elevated area 2 will, in this embodiment, have as a consequence that the device according to the invention may only be used in slopes having an angle of less than 60°. However, this is still possible and a slope of the ground II of down to 3° may be tolerated. In practice the device according to the invention may well be used on a flat surface.

Figure 2:
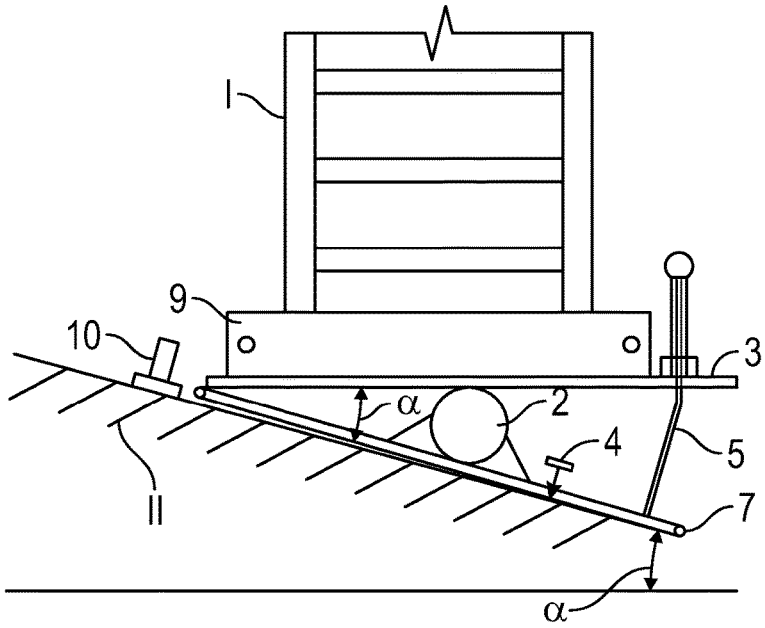
FIG. 2 depicts an embodiment of the device according to the invention being used for carrying a ladder and being erected on sloping ground.

To avoid that the plate 3 see-saws uncontrollably across the fulcrum 2, the plate 3 is equipped with locking devices 4 that may secure the plate 3 in the relevant angle in relation to the foundation 1. In the embodiment shown in FIGS. 1-2 the plate 3 is equipped with a wire-lead 5 running from the one end of the plate 3 across two rollers 5,7 being located in the foundation 1 and to the other end of the plate 3. When tilting the plate 3 relative to the foundation 1, this wire 5 will follow the tilting movement. By equipping this wire 5 with a locking device 4 the see-sawing movement of the plate 3 may be stopped and the tilting angle $\alpha$ may be adjusted/locked. Such a locking device may e.g. be a bolt or a wing-nut clamping the wire 5 against the foundation 1. Other locking devices for the wire 5 may also be used. The plate 3 may also be provided with alternative tilting restrictors.

It will also be possible to use other adjustment devices and securing devices for the tilting of the plate 3 with respect to the foundation 1 such as telescoping pipes running between the plate 3 and the foundation 1 (not shown). If such telescoping pipes are used, they may be equipped with locking devices to lock the adjustment devices in the same way as the wire 5.

Figure 5:
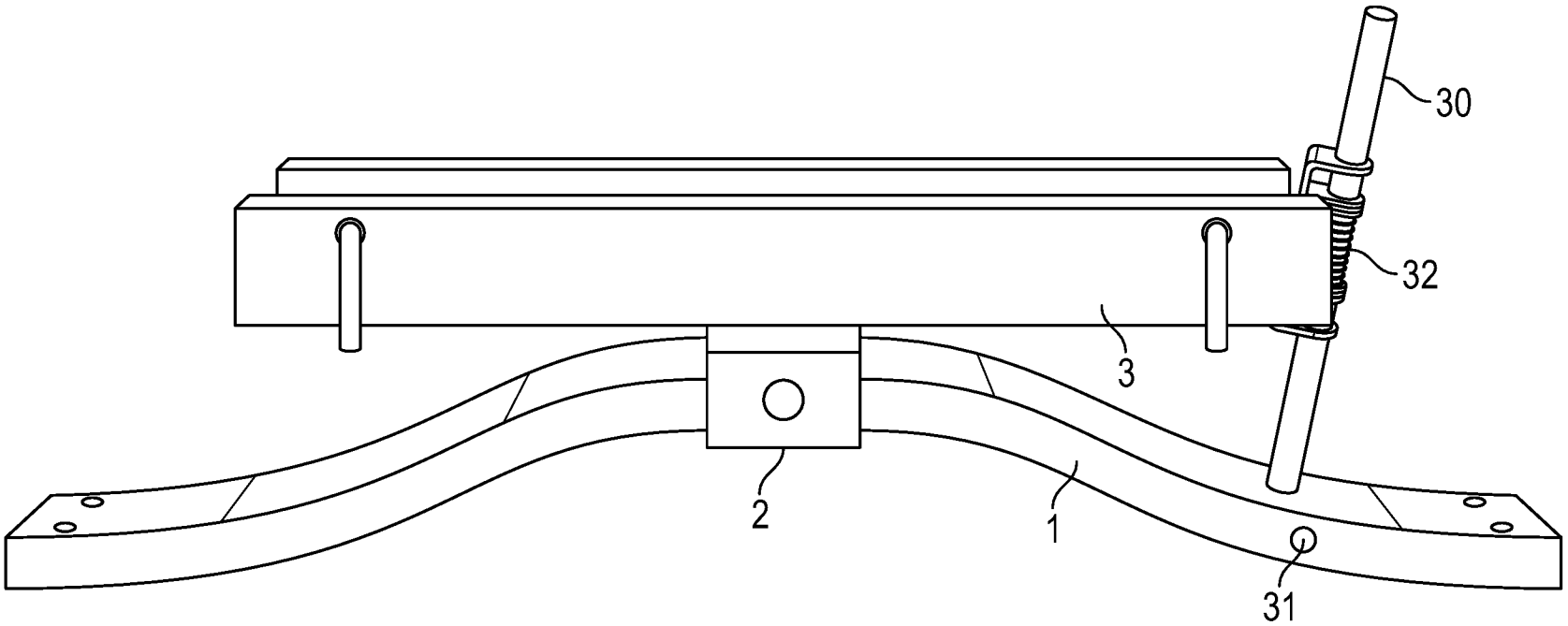
FIG. 5 depicts an alternative embodiment of the device according to the invention.

An alternative tilting restrictor device for the plate 3 is shown in FIG. 5. This tilting restriction device comprises a pole 30 running slideably through a hole in the plate 3. This pole 30 is secured in a tilting manner to the foundation 1 by a bolt 31 making it possible for the pole 30 to follow the tilting movement of the plate 3. The plate 3 is equipped with a securing device 32 locking the plate 3 to a selected position on the pole 30 ensuring that the plate 3 is locked in a substantially horizontal position when the foundation 1 is placed on a sloping surface.

Figure 6:
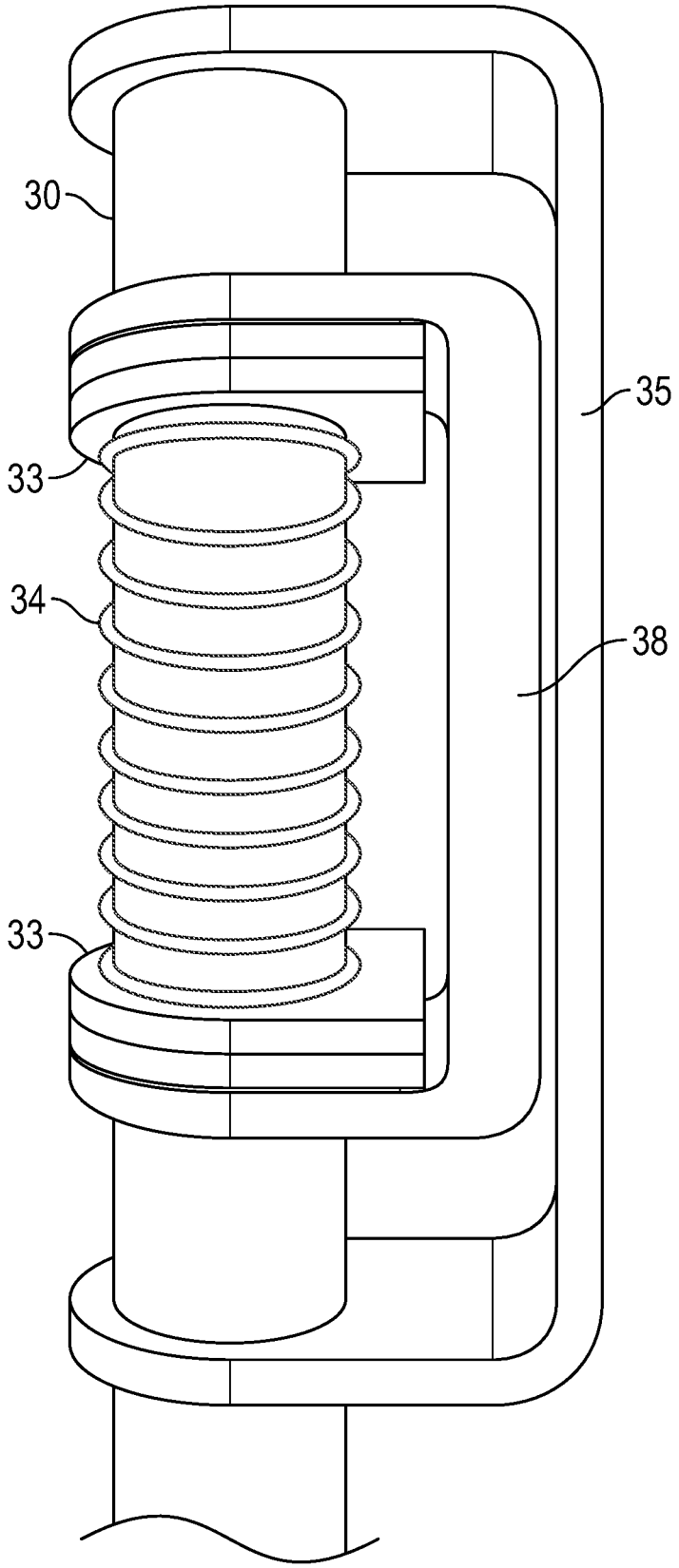
FIG. 6 depicts a possible locking device for the tilt of the device according to the invention.
Figure 7:
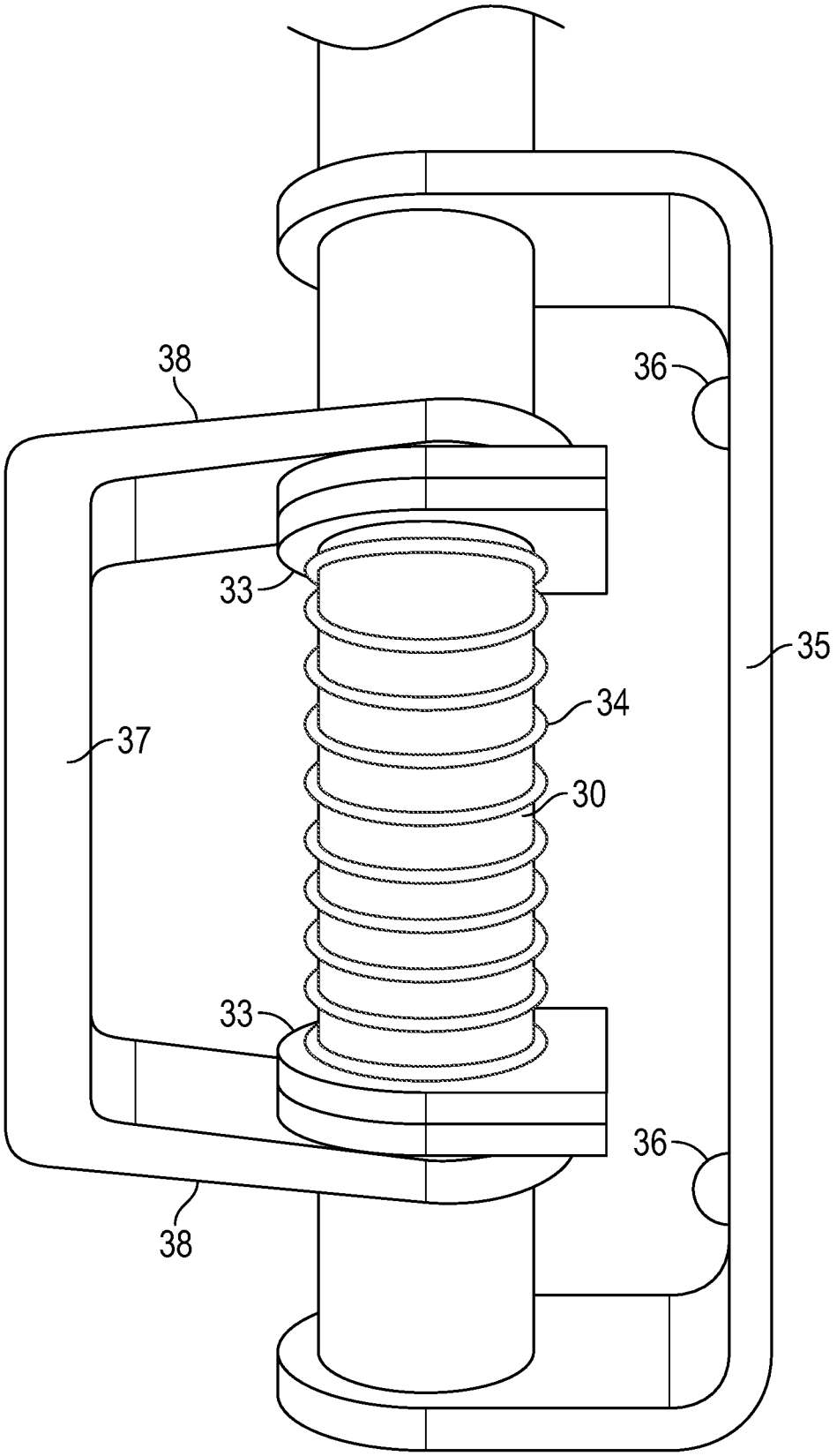
FIG. 7 depicts a detailed view of the locking device shown in FIG. 6.

In one embodiment the securing device 32 includes the structure/assembly shown in FIGS. 6 and 7. This securing device comprises a number of rings or plates 33 surrounding the pole 30 and with apertures being adjusted to pass the pole 30 loosely (clearance 1-1000 μm) when the rings or plates 33 are located perpendicularly or substantially perpendicularly to the surface of the pole 30, and to lock the plates or rings 33 in position when the plates have a different angle to the surface of the pole 30. For ensuring a skewed angle of the plates 33 towards the pole 30, the plates are separated by a coiled spring 34 surrounding the pole 30. To keep the plates/rings 33 in a skewed position through the action of the spring 34, the plates 33 are kept in place by a clamp 35 connected to the pole 30 and including two extensions 36 on each side of the plates 33 limiting the movement of the plates/rings 33 with respect to the pole 30 and ensuring the tilt of the plates/rings 33 with respect to the surface of the pole 30 through the action of the spring 34.

For releasing the locking device the tilt of plates/rings 33 need to be passed from their tilting position to the perpendicular position with respect to the surface of the pole 30. This may be done manually if the force of the spring 34 is not too great, or by using a tool (e.g. pliers) if the force of the spring may 34 not be countered by hand. In a particularly preferred embodiment the locking device 32 may include a releasing device 37 comprising a pair of plates 38 surrounding the pole 30 and having a tilted position with respect to the plates/rings 33. The plates/rings abut against the plates 38 of the releasing device 37. If the releasing device is to be inactive, the device is rotated to a position where the skewed plate 38 is not in touch with the locking plates/rings 33. This will activate the spring 34 bringing the plates/rings 33 into a skewed and locking position with respect to the pole 30. When rotating the releasing device 37 into contact with the locking plates/rings 33, the plates/rings 33 may be brought into the substantially perpendicular position with respect to the pole 30, letting the pole 30 pass freely through the holes in the locking plates/rings 33.

To ensure that the plate 3 is locked in a horizontal position the plate 3 may in one embodiment be equipped with a water and air bubble tool 8 for reading the angle of the plate. The existence of such a water and air bubble tool is still not essential for the function of the device according to the invention since an upright position of ladder I may be determined in a conventional manner by eyesight or in other ways.

It is also preferred to ensure that the ladder does not slip on the plate 3. In one embodiment this is accomplished by equipping the plate 3 with stoppers 9 preventing the ladder I from slipping off the plate 3 in such a device for nivellation of ladders being put up on a sloping surface II.

A device according to the present invention comprises a foundation 1 upon which there is placed an elevated area 2, said elevated area 2 functioning as a fulcrum/see-sawing point for a plate 3, onto said plate 3 a ladder I may be secured or carried, and said plate 3 being equipped with securing devices 4 that may secure the position of the plate 3 with respect to the foundation 1.

The foundation 1 is preferably a plate, a grid, a netting, a stand, etc. that in one embodiment may provide a foundation giving a good securing against the ground II.

The foundation 1 is preferably made of a rigid material such as wood, plastic or metal for carrying the weight of the structures above (ladder, tools, equipment, persons, etc.). The foundation 1 may also be hollow or carry a niche for, in the embodiments where this is relevant, harboring the wire 5 and rollers 6.

The foundation 1 may also in an alternative embodiment, carry further securing devices 10 against the ground II. Such securing devices 10 may take the form of spears, lances, spikes etc. Such securing devices 10 may be permanently fastened to the foundation 1 to be able to be rotated into an active position when using the device according to the invention, but they may alternatively be put into place when the device according to the invention is to be used (e.g. when the location of the device according to the invention is determined). Extra securing devices 10 may be relevant to use when the ground II e.g. includes sand, clay or other unsupportive or loose ground or if the ground is slippery (wet grass or the like).

The tilting fulcrum 2 is secured to the foundation 1. The fulcrum 2 is preferably secured to the middle area of the foundation 1. The middle area of the foundation 1 is the area including the middle point between ends of the foundation 1 and at a distance ±20 cm from this.

The fulcrum 2 may be made in such a way that it abuts against the plate 3 in one point. The cross section of the fulcrum 2 may consequently be of different types such as circular, oval or pyramidal.

The plate 3 may towards the fulcrum 2 in one embodiment be equipped with a socket or take-out (not shown). Such a socket or take-out may assist with the plate 3 not becoming displaced with respect to the foundation 1. In the embodiment comprising a wire 5 such a wire 5 may also assist with preventing a displacement between the plate and the foundation 1. By tightening the wire 5 the rollers 7 will function as supporting points for the location of the plate 3 because any displacement of the plate 3 in relation to the rollers 7 will, with a tight wire 5, increase the tightening of the wire 5 and thus prevent any displacement of the plate 3. The tightening devices for the wire 5 may be of a conventional type. It may also be possible to form the fulcrum 2 of a rotating bolt.

Figure 3:
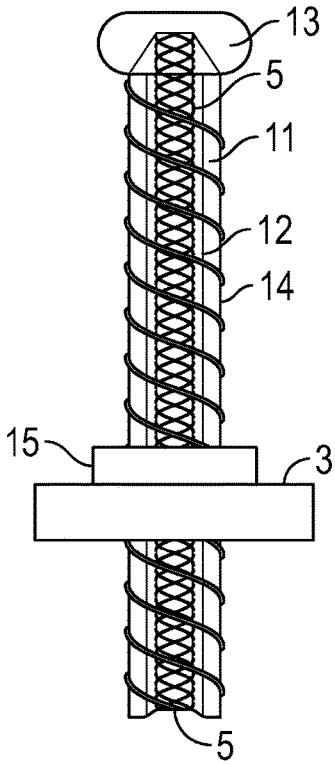
FIG. 3 depicts a tightening device. Such a tightening device may be suitable for tightening a wire being used in the nivellation device for ladders according to the invention.

A possible tightening device for the wire 5 is shown in FIG. 3. Such a tightening device comprises a pipe with a penetrating hole or opening 12 through which the wire 5 may pass. The wire 5 is equipped with devices preventing its slipping out through the hole 12 in the pipe 11. The is as an example shown in FIG. 3 by the wire 5 being bent, having a cross-pin secured or being tied in a knot 13 on top of the pipe 11 for preventing the wire 5 from being drawn down through the opening 12. The pipe 11 runs freely through the plate 3 and is on its outside equipped with threads 14 cooperating with a nut 15 abutting against the upper surface of the plate 3. By turning the nut 15 the location of the pipe 11 in relation to the plate 3 will be changed. The distance that the pipe rises above the plate 3 may thereby be regulated so that the wire 5 may be tightened of slacked.

The tightening device shown in FIG. 3 may also be used for other purposes than tightening the wire 5 in the nivellation device according to the invention, e.g. as a tightening device for struts at construction sites, within the shipping industry and other places where there is a need for tightening wires and ropes.

Figure 4:
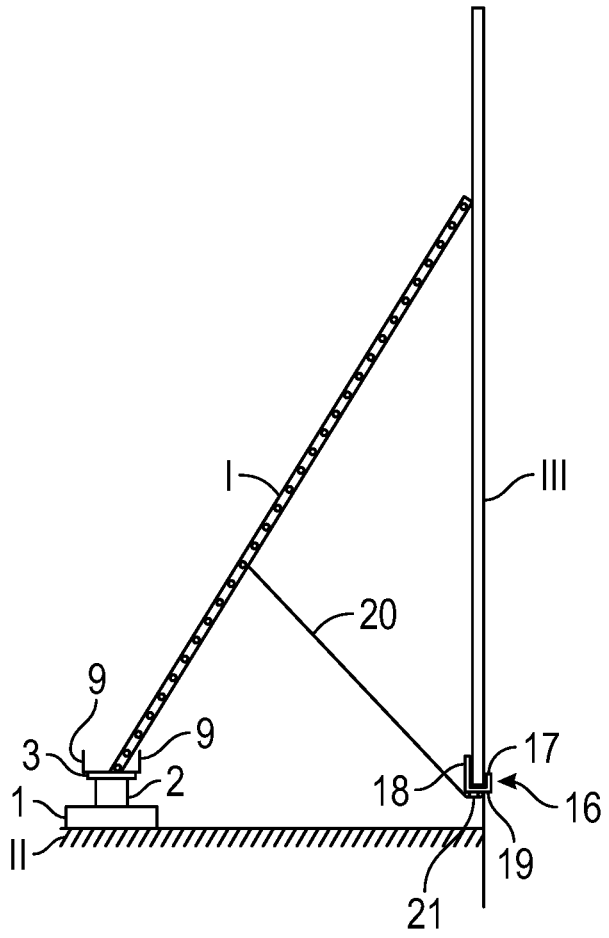
FIG. 4 depicts a support device for ladders, said support device securing the relevant ladder to the wall of a house or a house foundation or possibly to the relevant nivellation device.

A supporting device for ladders is shown in FIG. 4. Such a support device comprises a hook 16, said hook 16 may be secured to a building's wall III of a house. The hook 16 is comprise by two hook parts 17,18, said hook parts 17,18 being secured to each other in a sliding fashion through an intermediate part 19, e.g. by the outer hook part 17 running as a perpendicular extension of the intermediate part 19, and wherein the moveable hook part 18 is running in a groove being located in the intermediate part 19. The moveable hook part may be drawn towards the stationary hook part 17 through the aid of a wire or rope 20. The wire or rope 20 pulls the moveable hook part 18 towards the stationary hook part 17 by the wire/rope 20 running via a pulley or a running wheel 21 and from there to run towards a middle section on the ladder 1, notably a ladder step or one of the ladder sides. By tightening the wire or rope 20 the hook will simultaneously be secured to the building wall III and additionally secure the ladder from becoming drawn towards the securing point for the hook 16 to the building wall III. The wire/rope 20 may subsequently to the tightening be secured by e.g. being tied to the ladder 1. Thereby the ladder will be secured tightly without any immediate danger of slipping.

The nivellation device according to the invention may be presented as a separate device or may be constructed as a part of a ladder. A ladder and a nivellation device according to the invention may also be sold together as a kit.

In relation to the embodiment of the nivellation device according to the invention shown in FIG. 5 it is preferred that the securing device(s) comprises at least one pole 30 protruding from the foundation 1 and through the securing plate 3 for the ladder including locking/securing device(s) 32 preventing the plate 3 from see-sawing about the fulcrum 2. The locking/securing device(s) will in such an embodiment also function as load-bearing points for the load placed on the plate 3 (ladder, tools, paint, persons, etc.). In this connection it is possible to equip the foundation 1 with more than one such locking/load-bearing device, preferably at least one on each side of the fulcrum 2. Such a load-bearing function will ease the load placed on the fulcrum 2 while additionally distributing the load on the foundation 1.

In another embodiment it may also be possible to equip the foundation 1 with horizontally protruding legs for providing an improved cross-stabilization of the device (not shown).

EXAMPLES

Example 1

The nivellation device according to this example is made mainly from wood. The foundation 1 comprises in this example a wooden plate with a thickness of 2 cm, a length of 1 m and a width of 10 cm. At the middle point of foundation 1 there is located a reinforcement in the form of a metal plate with a length of 45 cm and a width of 3 cm being placed in a socket in the foundation 1 extending above the upper surface of the foundation 1 at a distance of 0.5 cm, onto which metal plate the fulcrum 2 is centrally mounted. The fulcrum 2 comprises in this example a metal pipe (steel pipe) with a diameter of 7 cm. This pipe is mounted across the foundation 1. On top of the fulcrum 2 there is loosely placed a wooden plate 3 with dimensions length=80 cm, width=10 cm and thickness=3 cm onto which a ladder may be mounted. To this plate 3 there are mounted side plates 9 with dimensions length=80 cm, height=10 cm and thickness=1.5 cm.

The plate 3 is mounted to the foundation 1 through the aid of a wire 5 being passed from a securing point at the one end of the plate 3 via a pulley wheel 6 in the foundation 1 wherein the pulley wheel 6 runs mainly perpendicularly under the one end of the plate 3, and wherein the wire 5 runs across the length of the foundation 1 to the second pulley wheel 7 being located in the foundation 1 and perpendicularly across from the second end of the plate 3, for running through this second pulley wheel 7 and to be secured to the second end of the plate 3 via a tightening device for the wire 5. In at least one point the wire 5 may be blocked against the foundation 1 via a clamping device 4 for securing that the plate 3 may not see-saw across the fulcrum 2 when the wire 5 is clamped tight against the foundation 1.

By having the clamping device 4 initially loose the plate 3 may see-saw across the fulcrum 2 so that the plate 3 may be oriented horizontally.

Example 2

The nivellation device according to this example is constructed in the same way as in Example 1, except that the material in the device here is steel plates with a thickness of 1.0 cm.

Example 3

In this example the construction of the nivellation device is the same as explained supra except for, instead or in addition to the securing device 4, there is present a securing nut between a sheath on the outside of the fulcrum 2, said sheath being secured to the upper edge of the plate 3. By tightening the set-nut between the sheath and the fulcrum, the angle of the plate 3 is securely established.

The invention claimed is:

1. A device for crosswise nivellation of ladders being erected on a ground being sloping or flat, characterized in that such a device comprises a foundation onto which there is secured/placed an elevated area, said elevated area functioning as a fulcrum/see-sawing point for a plate onto which plate there may be placed or secured a ladder, and said plate being equipped with securing devices that may stay the position of the plate in relation to the foundation and wherein the plate is equipped with side plates and wherein the plate or the side plates are equipped with a device for measuring an angle of the plate to ensure the plate is in a horizontal position, wherein the securing devices comprise the plate being secured to the foundation through the aid of a wire running between the ends of the plate via wheels existing in the foundation, characterized in that the wire is equipped with a tightening device comprising a threaded pipe extending through the plate and a nut on the pipe abutting against an upper surface of the plate.

2. The device according to claim 1, characterized in that the foundation may be placed in slopes with a sloping angle in the interval 0-60°.

3. The device according to claim 1, characterized in that the foundation is equipped with securing devices such as anchors and/or lances that may secure the foundation to the ground.

4. The device according to claim 1, characterized in that the foundation is equipped with a slip-free base.

5. The device according to claim 1, characterized in that the plate is equipped with a slip-free surface.

6. The device according to claim 1, characterized in that the foundation includes at least one horizontal brace for side-stabilization.

7. The device according to claim 1, characterized in that the device for measuring an angle of the plate to ensure the plate is in a horizontal position is an air bubble device or spirit level.

* * * * *